US005142981A

United States Patent [19]

Dettinger et al.

[11] Patent Number: 5,142,981

[45] Date of Patent: Sep. 1, 1992

[54] PRINTING SPEED DEPENDENT THROW ON/OFF CONTROL SYSTEM FOR A SHEET-FED OFFSET PRESS

[75] Inventors: Dietrich Dettinger, Heusenstamm; Horst Klingler, Offenbach am Main, both of Fed. Rep. of Germany

[73] Assignee: MAN Roland Druckmaschinen AG, Fed. Rep. of Germany

[21] Appl. No.: 690,654

[22] Filed: Apr. 24, 1991

[30] Foreign Application Priority Data

Apr. 25, 1990 [DE] Fed. Rep. of Germany ..... 4013106

[51] Int. Cl.[5] ..... B41F 33/04

[52] U.S. Cl. ..... 101/248; 101/247; 101/218; 101/145; 101/DIG. 36; 101/409

[58] Field of Search ..... 101/246-248, 101/216-218, 145, 232, 409, DIG. 36

[56] References Cited

FOREIGN PATENT DOCUMENTS 1098963 2/1961 Fed. Rep. of Germany .

*Primary Examiner*—Edgar S. Burr
*Assistant Examiner*—Eric P. Raciti
*Attorney, Agent, or Firm*—Leydig, Voit & Mayer

[57] ABSTRACT

In a sheet-fed offset press having at least one printing unit in which the blanket cylinder can be thrown on and off the impression cylinder and plate cylinder by a pressure-medium-energized actuating arrangement, the pressure medium energization is triggered by a control unit in accordance with the position of grip edge zones of the cylinders being in registration. In order to ensure that throwing on and throwing off take place when the grip edge zones of the cylinders are positioned immediately opposite one another, the control unit detects the position of the printing unit cylinders relatively to one another by way of an angular position sensor and also detects the actual speed of the press via a speed sensor. The control unit forms speed-dependent throw-on and throw-off actuating times which are advanced in the direction of rotation of the printing unit cylinders so that the reaction time is outside the time slot for grip edge zone registration. The invention reduces the very substantial constructional outlay needed in the case of pressure-medium-energized actuating arrangements to ensure reliable throw-on and throw-off at high printing speeds.

12 Claims, 6 Drawing Sheets

PRINTING SPEED DEPENDENT THROW ON/OFF CONTROL SYSTEM FOR A SHEET-FED OFFSET PRESS

CROSS-REFERENCE TO RELATED APPLICATION

This patent application is a co-pending application of U.S. patent application having Ser. No. 07/691,223, filed on Apr. 25, 1991, which is hereby incorporated by reference.

FIELD OF THE INVENTION

The present invention relates generally to sheet-fed offset presses, and more particularly to control systems for initiating throw on/off procedures of an offset press.

BACKGROUND OF THE INVENTION

Control systems for initiating throw on/off procedures for sheet-fed offset printing presses are generally known in the art. For example, references DE-AS 1 Q98 963, DD-PS 86 631 and DE 3 232 171 Al all disclose sheet-fed offset printing presses utilizing pressure-operated actuating means for throw-on and throw-off procedures. As disclosed in the above cited references, a blanket cylinder is placed in contact with a plate cylinder and/or an impression cylinder during each throw-on procedure, thus forming a nip at the point of contact, and the blanket cylinder is separated for the plate cylinder and/or the impression cylinder during the throw-off procedure.

The plate, blanket and impression cylinders all include grip edges for securing a sheet of paper, a printing plate, and an output for the ink supply, respectively. During both throw-on and throw-off procedures, the blanket cylinder is placed in contact with or removed from the plate and impression cylinders one at a time, i.e., in a sequential order. A grip edge zone exists on the surface area of a cylinder, defined by the circumferential area between the grip edges that is not covered by the paper sheet, printing plate or ink supply. In operation, the grip edge zones of opposing cylinders are in contact or immediately adjacent to each other (if the corresponding cylinders are not in contact) during throw-on and throw-off procedures, and, therefore, are considered to be in "registration." This registration of the grip edge zones is necessary in order to ensure proper printing of each sheet. When printing is interrupted, the blanket cylinder is thrown off the plate cylinder after the last sheet is printed. The blanket cylinder is thrown off the impression cylinder in order to ensure unneeded ink is not transferred to the blanket cylinder. Similar considerations apply to the throw-on procedure.

In conventional control systems, timers are used to activate the throw-on and throw-off procedures at a particular time and in a particular sequence. These timers are driven in synchronism with the press and include cams that control various changeover valves that regulate devices for actuating the throw on or throw-off of the blanket cylinder. Throw-on or throw-off is generally initiated when the grip zones enter the nip between two cylinders. In order to ensure that throw-on and throw-off procedures occur at the end of printing (i.e., a time when the relevant grip edge zones are in registration), triggering signals are adjusted to occur as the grip edge zones enter the nip and towards the end of printing.

A disadvantage of an actuating time for throw-off and throw-on that is in a fixed relationship to press position and located inside the grip edge zones is that in the case of a high speed press there is only a very short time slot available between the time of initiating the actuating device and the time at which the blanket cylinder has been completely thrown on or thrown off the impression cylinder or plate cylinder. Following conventional designs, the actuating device would have to be designed to operate at very high speeds, and thus tolerate very high driving pressure forces in order to ensure that throw-on and throw-off could be completed entirely within the time during which the grip edge zone of the relevant cylinders are in registration. Such a design would be very expensive, and therefore, is undesirable.

OBJECTS AND SUMMARY OF THE INVENTION

In view of the foregoing, it is a primary object of the present invention to provide means for actuating throw-off and throw-on procedures in an offset press that can operate effectively at very high printing speeds and can be achieved at a relatively cost effective price.

Briefly, the present invention provides a sheet-fed offset press having at least one printing unit in which the blanket cylinder can be thrown on and off the impression cylinder and plate cylinder by a pressure-driven actuating device, and activation of a pressure supply for the actuating device is triggered by a control unit dependent upon the position of the grip edge zones of press cylinders in registration. To ensure that throwing on and throwing off take place when the grip edge zones of the cylinders are in registration, the control unit detects the position of the printing unit cylinders relative to one another by means of an angular position sensor and a rotational speed sensor for the printing cylinders. The control unit calculates speed-dependent throw-on and throw-off actuating times which are advanced in the direction of rotation of the printing unit cylinders so that the reaction time is outside of the time slot for grip edge zone registration. The design provided by the present invention eliminates the need for costly actuating means that would conventionally be required to ensure reliable throw-on and throw-off at high printing speeds.

Other objects and advantages of the present invention will become apparent upon consideration of the following detailed description when taken in conjunction with the drawings.

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of the invention.

DETAILED DESCRIPTION OF THE PREFERRED EMBODIMENTS

Figure 1C:
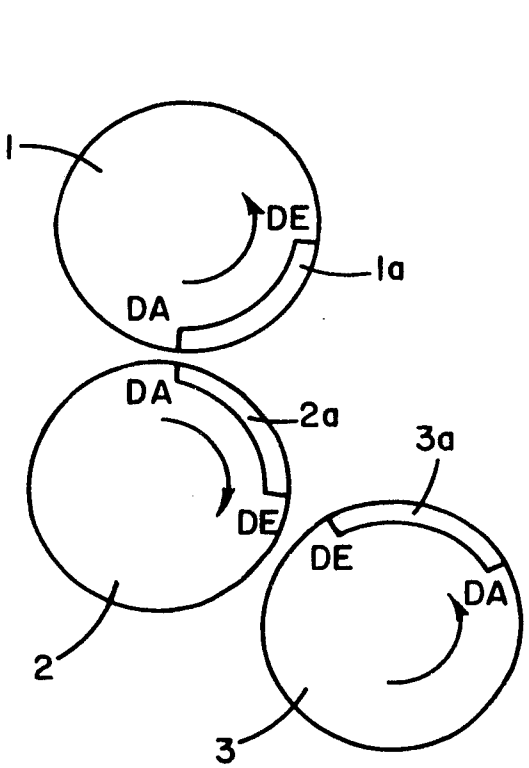
FIGS. 1*a*–1*c* show printing cylinders of a sheet-fed offset press.
Figure 1B:
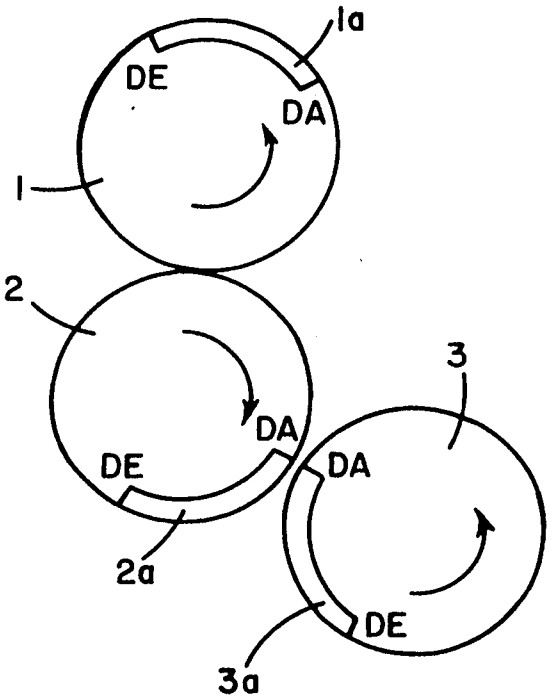
Figure 1A:
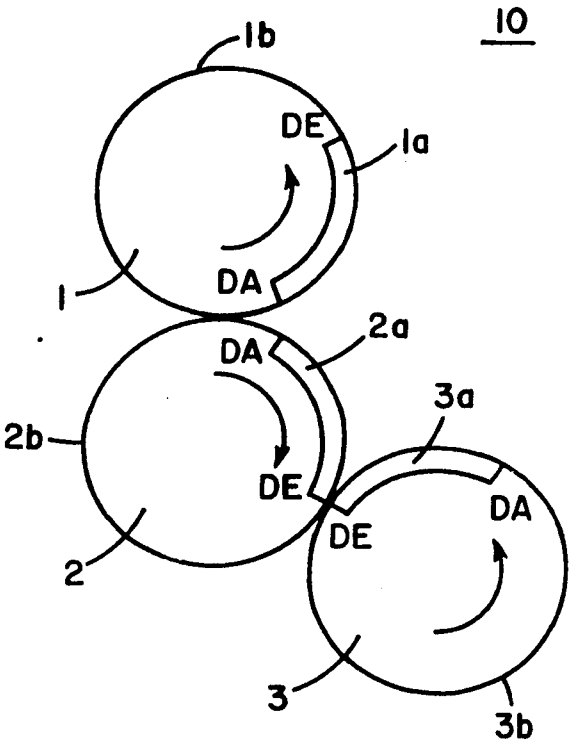

Turning now to the drawings, FIGS. 1*a*–1*c* sequentially illustrate a throw-off procedure of printing cylinders 10 in a printing unit of a sheet-fed offset printing press, wherein the printing cylinders 10 include a plate cylinder 1, a blanket cylinder 2 and an impression cylinder 3. In order to perform a throw-on or throw-off procedure, the blanket cylinder 2 is generally mounted eccentrically at both ends and can be thrown on and off the impression cylinder 3 and plate cylinder 1 by means of double-acting pressure-driven cylinders pivotally connected to the blanket cylinder 2, as disclosed in reference DE-AS 1 098 963.

The previously cited references DE-PS 86 631 and DE 3 232 171 Al both disclose throw-on and throw-off devices having pressure-driven actuating device that can position, or "throw," the blanket cylinder 2 on and off the plate cylinder 1 and the impression cylinder 3. Eccentric mountings including levers are also provided for at least the blanket cylinder 2, which in conjunction with a corresponding actuating device (double-acting working cylinders shown in FIG. 5), the blanket cylinder 2 can, starting from the thrown-on state shown in FIG. 1*a*, initially be thrown off just the impression cylinder 3. In the position shown in FIG. 1*b*, the blanket cylinder 2 and the plate cylinder 1 are still in contact with one another. To stop printing completely the blanket cylinder 2 is thrown off the plate cylinder 1 by the actuating device as shown in FIG. 1*c*.

The blanket cylinder 2 is thrown on and off the impression cylinder 3 and plate cylinder 1 in the time slot in which grip edge zones 1*a*, 2*a* and 3*a* of the respective cylinders 1, 2, 3 are in registration with one another. The throw-off instruction can be triggered either manually by an operator or by monitoring means such as a photocell. In either case, when a sheet of paper is not present at a preliminary gripper of the plate cylinder 1, the blanket cylinder 2 is thrown off the impression cylinder 3, and after a number of arbitrary predetermined further revolutions, the blanket cylinder 2 is then thrown off the plate cylinder 1.

The throw-on procedure occurs in the following manner. The throw-on instruction is given after the first sheet is positioned correctly at lays (not shown) of the printing cylinders 10, and the blanket cylinder 2 is thrown on the plate cylinder 1, wherein the corresponding grip edges of the blanket and plate cylinders are in registration. After a necessary number of revolutions, as is required for pre-inking of the blanket cylinder 2, a paper sheet is transferred from a preliminary gripper to the printing cylinders 10. When the grip edge zones 2*a* and 3*a* are in registration with one another, the blanket cylinder 2 is thrown on the impression cylinder 3, thus enabling the first paper sheet to be printed. If there is more than one set of printing cylinders 10, the other printing cylinder units throw off or on sequentially. A control unit 4 (FIG. 4*a*) regulates the throw on/off procedure, especially if there are more than one set of printing cylinders 10 as disclosed in reference DE 2 607 808 A1.

Figure 2:
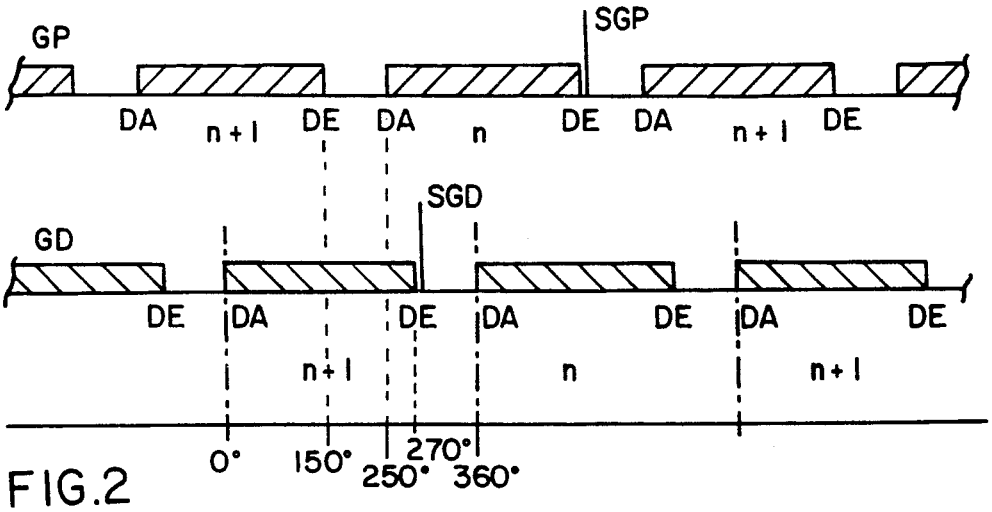
FIG. 2 is a timing diagram illustrating registration between grip edge zones.

FIG. 2 is a timing diagram corresponding to the registration time of the grip edge zones over a period of three revolutions. Registration between corresponding grip edge zones is symbolized by a flat, horizontal line, and non-registration of corresponding grip edge zones is symbolized by blocked-out portions of the time line. Registration between the plate cylinder 1 and the blanket cylinder 2 is illustrated in the upper time line designated as GP. The lower time line designated as GD corresponds to the registration period between the blanket cylinder 2 and the impression cylinder 3.

These three revolutions also correspond to the printing of three sheets designated as sheets n−1, n and n+1. The offset between the lines GP and GD corresponds to the arrangement of the printing cylinders as shown in FIGS. 1*a*, 1*b* and 1*c*. Sheet n on the GD time line precedes the corresponding sheet n on the GP time line because ink for the n sheet must first be transferred from the impression cylinder 3 to the blanket cylinder 2, which in turn prints onto the paper sheet n on the plate cylinder 1. In the time lines GD and GP, DA indicates the beginning of a printing zone and DE indicates the end of the printing zone between two cylinders whose printing zones are in registration.

The time line GD includes an angle scale (0° to 360°) for press position corresponding to the sheet n−1. The 0° position is arbitrary, but for this discussion zero degrees (0°) defines the simultaneous positioning of the print start of the blanket cylinder 2 and the print start of the impression cylinder 3. The printing cylinders 10 reach the 0° position when the print start DA of the blanket cylinder 2 and the impression cylinder 3 are adjacent one another. In the illustrated embodiment, the angular radius of the grip zones of the cylinders is 90°; however, the angular radius of the grip edge zones can vary in other embodiments. Accordingly, the 270° angular position of the timing diagram corresponds to the positions of the cylinders 2 and 3 when their print ends DE are adjacent to one another. Positions between 270° and 360° correspond to the respective positions of the blanket cylinder 2 and the impression cylinder 3 wherein their grip edge zones 2*a* and 3*a*, respectively, are in registration. Registration of the print zones 1*b*, 2*b*, 3*b* on the cylinders 1, 2, 3, respectively, can also be determined by the timing diagram in FIG. 2. Referring to time line GP, when the printing cylinders 10 are at a position between 150° and 250°, the grip edge zones 1*a*, 2*a* of the cylinders 1, 2, respectively, are in registration with one another. Similarly, between 0° and 270° of time line GD, the printing zones 2*b*, 3*b* of cylinders 2, 3 are in registration.

If the blanket cylinder 2 is required to be thrown off the impression cylinder 3 after sheet n−1 because sheet n is a defective sheet, a conventional timer produces a trigger signal SGD that activates the pressure supply of the pressurized actuating device in order to begin the throw-off procedure. The SGD trigger pulse is illustrated on the GD time line. If it is also necessary to immediately throw the blanket cylinder 2 off the plate cylinder 1 as well, the timer produces a trigger pulse SGP to the pressure supply of the actuating device in order to throw the blanket cylinder 2 off the plate cylinder 1. Accordingly, the SGP trigger pulse is illustrated on the GP time line.

Similar considerations apply to the throw-on procedure, except that the trigger pulse SGP for throwing the blanket cylinder 2 on the plate cylinder 1 occurs at least one whole revolution of the printing cylinders 10 before the time SGD. According to FIG. 2, the trigger pulses SGD and SGP occur at the beginning of grip edge registration, which occurs shortly after the end of the print zones DE of the corresponding cylinders are adjacent to one another. Positioning the trigger pulses SGD and SGP at these locations of the timing diagram ensures that almost the entire width of the grip edge zones are available for the blanket cylinder 2 to be thrown-on and thrown-off. Within this angular range, which is dependent upon printing speed, the actuating device must be energized to completely engage the blanket cylinder 2 with the plate cylinder 1 or the impression cylinder 3, or to completely disengage the blanket cylinder 2 from the cylinders 1 and 3.

The actuating device have basically two kinds of forces to overcome: (1) the force required to throw the blanket cylinder on and off the plate cylinder 1 and the impression cylinder 3, including contact pressure between cylinders, and (2) the inertia of the blanket cylinder 2 and its bearings as a result of the throw-on or throw-off movement from the initial position to the end position. The first force component is approximately independent of the printing speed, but the second component increases considerably with increasing printing speed since the time in which the grip edge zones are in registration with one another decreases, but the distance that the blanket cylinder 2 has to travel between positions remains constant. Maximum separation between the blanket cylinder 2 and the plate cylinder 1 and between the blanket cylinder 2 and the impression cylinder 3 should be reached during throw-off while the grip edge zones are still in registration with one another. A simple calculation can show that the forces to be provided by the actuating device increase with the square of the printing speed.

The time slot available for throw-off and throw-on procedures is further reduced by a "reaction time" that elapses between the triggering of the actuating device at the times SGD, SGP and the reaction of the actuating device. The reaction time includes factors such as the necessary pressure build-up to drive the actuating device and the retraction or extension of piston rods in double-acting working cylinders. Furthermore, the actuating device takes a period of time for its pistons to reach their maximum operating speed. For example, at high piston speeds the piston is braked before reaching its end position by a narrow cross-section outlet orifice.

Modern printing speeds can reach 20,000 sheets per hour. Accordingly, throw-on and throw-off procedures utilizing a pressure-driven actuating device are only feasible if the actuating device is capable of executing throw-on and throw-off procedures within the time period during which the grip edge zones of the relevant cylinders are in registration. At first glance, it would seem that a pneumatic actuating device capable of executing throw-on and throw-off procedures within such a short period of time would require very high operating pressures and thus be too costly to merit implementation.

In accordance with the present invention, timing means are provided for enabling conventional pneumatic actuating devices to be utilized to execute throw-on and throw off procedures at very high printing speeds. The present invention provides a timing mechanism that adjusts the positioning of the trigger pulses SGD and SGP according to the printing speed, thereby providing the actuating device with adequate time to execute throw-on and throw-off procedures while the corresponding grip edge zones of the relevant cylinders are in registration. The present invention detects the present printing speed of the printing cylinders and positions the trigger signals SGD, SGP at the appropriate angular position in order to provide the actuating device with adequate time to execute throw-on and throw-off procedures.

Figure 3:
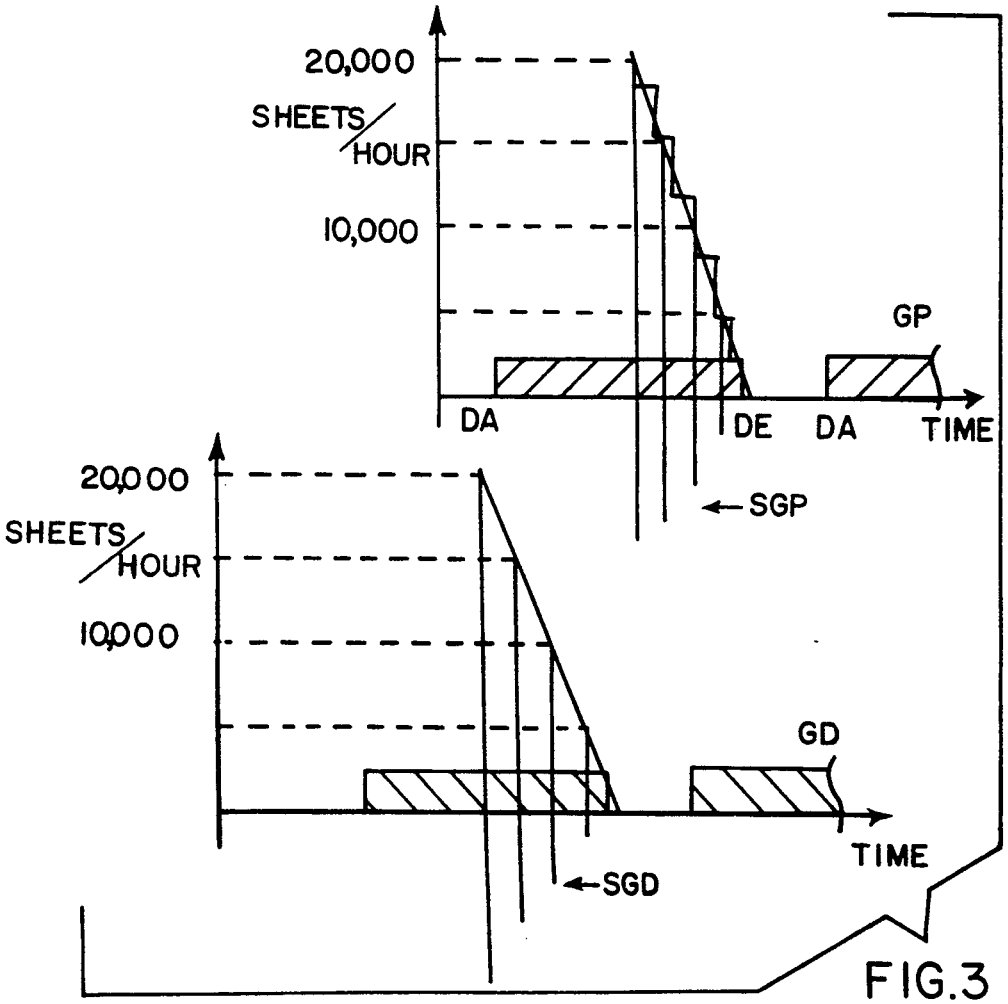
FIG. 3 illustrates advance of initiating signals that have been determined based upon press speed.

Referring to FIG. 3, a timer 4*a* (FIGS. 4*a* and 4*b*) positions the throw-on and throw-off trigger pulses at appropriate angular positions depending upon the printing speed of the press. FIG. 3 illustrates the trigger pulses SGD, SGP being advanced as the printing speed increases. The abscissae of the diagrams corresponds to the printing speed in sheets per hour, and the ordinate corresponds to the time lines GD and GP.

The speed-dependent position of the times SGD, SGP may be obtained, in the simplest case, by linear extrapolation as shown in FIG. 3. Using linear extrapolation, the times SGD, SGP are advanced in direct proportion to the printing speed. Furthermore, and in accordance with another aspect of the present invention, the advance positioning of the trigger pulse SGD, SGP can be determined empirically or by model-based calculation. Another possibility is for the times SGD, SGP to be advanced stepwise relative to press speed. This means that in a first speed range an advance of a predetermined angle is made and in the next speed range an advance through a correspondingly greater angle is made and so on. This corresponds to a stepped characteristic.

The amount of advance initially depends upon the size of the reaction time slot between the actuating time (triggering of the pressure medium of the actuating device) and a first operative reaction of the actuating device as a result of pressure medium energization (pressure build-up in the working chambers on the pistons). Within this reaction time slot there is also the actuating time (time for the valves to open or close). Also, the trigger pulses or time periods SGD, SGP should be advanced along their respective time line dependent upon press speed such that at every speed of the printing cylinders 10 the blanket cylinder 2 reaches its maximum throw-off position relative to the impression cylinder 3 and plate cylinder 1 within the time slot that the relevant grip edge zone are in registration. Similarly for the throw-on procedure, the times SGD, SGP should be advanced far enough that at the beginning of the print start DA the blanket cylinder 2 has already been fully thrown-on the corresponding cylinders with the required contact pressure.

Since the blanket cylinder 2 makes no throw-on or throw-off movement during the "reaction time," advancing the time SGD, SGP based on the press speed enables the whole width of the grip edge zones to be available for such movement. Consequently, moving the reaction time out of the grip edge zone by advancing the times SGD, SGP does not shorten the time available for the movement of the blanket cylinder 2 to the desired position.

Figure 5:
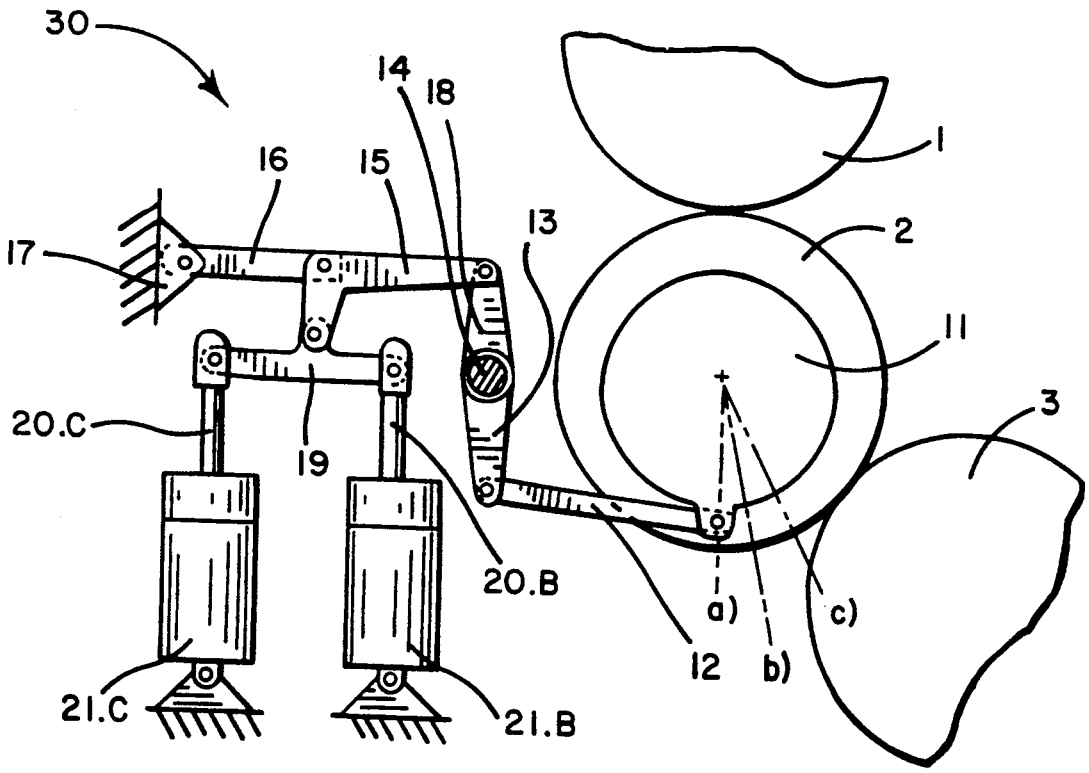
FIG. 5 illustrates an advantageous embodiment of a throw-on/throw-off device having double-acting pneumatic cylinders.

In accordance with another important aspect of the present invention, means are provided for measuring the time taken by the actuating device to execute the throw-on and throw-off procedures. Sensors are provided on the actuating devices that are in communication with the timer 4*a*, thus enabling a measurement to be made of the time elapsing from delivery of the actuating signals (times SGD, SGP; triggering of solenoid valves) to a first effective reaction of the actuating device as a result of the pressure supply being activated. If the actuating device includes double-acting working cylinders as illustrated in FIG. 5, the reaction time is defined as the time elapsing between the delivery of the actuating signal and the start of a stroke of a working piston (beginning of the extension or retraction of a piston rod). In the case of the double-acting working cylinders, "stroke time" is defined as the time period for a piston rod to fully retract or extend.

Regardless of the specific embodiment of the actuating device, the present invention utilizes these time periods in conjunction with speed-dependent calculation advance to properly position the trigger pulses or actuating times SGD, SGP. Accordingly, the positioning of the trigger pulses is not just dependent upon printing speed, but also on the reaction time as determined from an immediately preceding throw-on or throw-off procedure.

If the stroke time of the actuating device is detected, the speed-dependent advance of the times SGD, SGP can also be effected by the stroke speed as determined from an earlier, or preferably an immediately proceeding, throw-on or throw-off procedure. If high stroke speeds are found, the times SGD, SGP may need to be advanced less (a smaller angle) than for a lower stroke speed. Therefore, the advance of the times SGD, SGP is further adjusted in accordance to the stroke speed. This features also provides the additional advantage of being able to determine whether the stroke time (stroke speed) of the actuating device is increasing because of aging, wear or other reasons. Accordingly, an operator is notified of possible servicing and repair needs before they become a problem or present a dangerous situation.

Figure 4A:
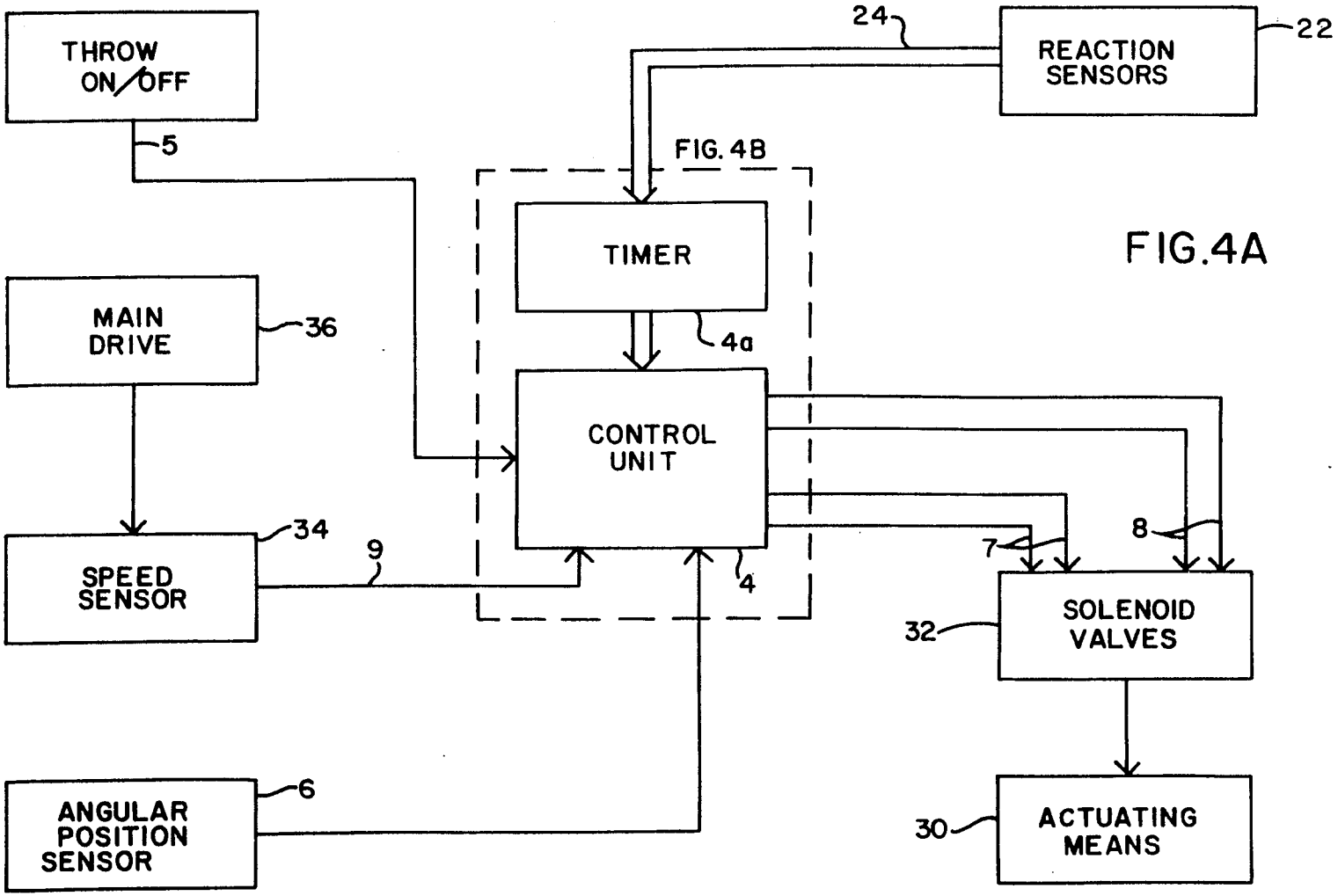
FIGS. 4*a* and 4*b* are block circuit diagrams of a control unit of the present invention.

Turning now to FIG. 4*a*, an exemplary control unit 4 for a offset printing press is illustrated in accordance with the present invention. A trigger line 5 is in communication with the control unit 4 for transmitting a throw-on or throw-off instruction to the control unit 4. An angular position sensor 6 monitors the printing speed by rotating synchronously at the speed of the printing cylinders 10. Upon receiving a throw-on or throw-off instruction, the control unit 4 outputs an actuating signal to the actuating means 30 via control lines 7, 8 which are connected to solenoid valves 32 of the pressure source. The actuating means 30 are illustrated in detail in FIG. 5. Conventional means for producing actuating signals SGD, SGD, such as disclosed in the reference DE 2 607 808 A1, are dependent solely upon the angular positioning of the cylinders 1, 2 and 3, and do not incorporate variable factors such as press speed, reaction time, stroke time, and activation time.

Accordingly, the present invention provides a control unit 4 that determines the angular positions for the throw-on and throw-off markers based upon the printing speed. The control unit 4 receives via signal line 9 the actual speed of the printing cylinders from a speed sensor 34, preferably in digital format. In practice, the speed signal can be derived from the main drive 36 since the actual speed signal is already provided to regulate the printing speed. In general, the actual speed signal can generally be any signal whose value reflects press speed. The angular position sensor 6 is synchronized with the printing cylinders and may be a high-resolution 12-bit, angular position sensor. The angular position sensor 6, for example, can be in communication with a shaft of the printing cylinders 10.

Figure 4B:
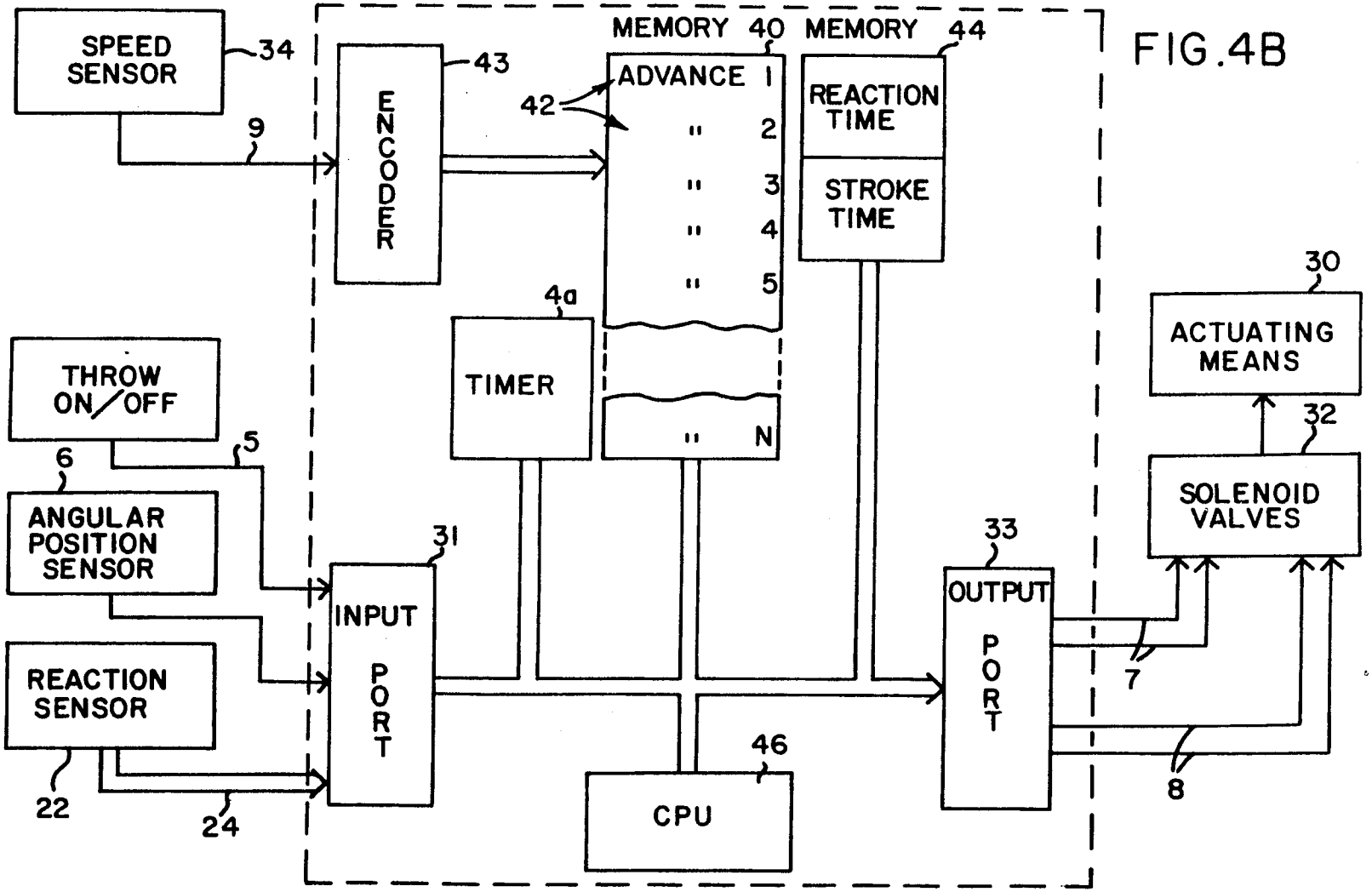

Referring to FIG. 4*b*, the control unit 4 calculates and determines the angular positions of the actuating signals in real time. In a conventional manner, the control unit 4 is configured to include an input port 31 for the throw-on, throw-off signal, the position signal from the senor 6, and the actual speed signal from the speed sensor 34. The control unit 4 also includes an output port 33 for communicating the actuating signals to the lines 7, 8. The control unit 4 operates the actuating means 30 for executing the throw-on and throw-off procedures via the lines 7, 8 by way of the electrically operated solenoid valves 32.

Two double-acting pneumatic cylinders 21.C, 21.B are provided for executing the throw-on and throw-off procedures. Consequently, four working chambers are provided per printing unit for throw-on and throw-off procedures. These four chambers are driven by compressed air that is controlled by the electrically operated solenoid valves 32 that are triggerable, as shown in FIG. 4*a*, by way of four control lines 7, 8.

In the preferred embodiment, the control unit 4 is connected to reaction sensors 22 of the actuating means 30 via line 24. The reaction sensor 22 transmits a signal pulse when a piston of the actuating means 30 begins a stroke. A timer 4*a*, that is included in the control unit 4, detects the time period between delivery of the actuating signals (times SGD, SGP that trigger the valves by way of the control lines 7, 8) and the reaction of the actuating means 30. The reaction time is then used to calculate subsequent positioning of the trigger marks.

If desired, the stroke time of the actuating means 30 is transmitted to the control unit 4 via separate lines in the line 24, wherein one line transmits a pulse at the beginning of the stroke and another line transmits a pulse at the end of the stroke movement. The reaction sensor 22 thus enables the timer 4*a* to determine the stroke time of the actuating means 30.

The speed-dependent SGD trigger pulse for throwing the blanket cylinder 2 on and off the impression cylinder 3 can be advanced by an angular position corresponding to the sum of the reaction time and the stroke time, wherein the resulting angular position of the trigger pulses provides the actuating means 30 with sufficient time to completely throw the blanket cylinder 2 on or off the impression cylinder 3 while the relevant grip edge zones are in registration.

The control unit 4 producing a speed-dependent advance of the times SGD, SGP in association with the sensors of the actuating means and of the reaction and/or stroke times as determined by the timer 4*a* can be called a self-adjusting control system, since the angular positioning of the trigger marks are determined by preceding reaction and/or stroke times.

In one embodiment the control unit 4 calculates the necessary angular positions of SGD and SGP, thus determining when the actuating signals should be present on the control lines 7, 8 after a throw-on or throw-off instruction has been transmitted via the instruction line 5. The control unit 4 calculates the SGD, SGP positions corresponding to various speed ranges just once, for example, when the press is taken into operation, and places each set-value position for the particular speed range in an independent storage cell of a memory 40.

FIG. 4*b* is a more detailed schematic block diagram of the control unit 4 shown in FIG. 4*a*. Each cell 42 of the memory 40 receives and stores an angular position corresponding to a range of printing speeds as determined by the control unit 4. The reaction time and stroke time are stored in a second memory 44. A central processing unit (CPU) 46, such as a microprocessor in the control unit 4, quickly obtains the angular position from the memory 40 by means of an encoder 43 that addresses the proper cell 42 based on a speed signal from the speed sensor 34, thus enabling the CPU to quickly receive the proper angular position. Storing the angular positions for the SGD, SGP trigger pulses in addressable memory locations saves computing time and ensures that the necessary actuating signals can be calculated, stored and retrieved very quickly.

The number of speed classes or speed ranges in which the total speed range of the press is subdivided depends upon the digital resolution of the speed signal and the available number of memory locations 42 or storage units addressable by the encoder 43 based on the speed signal. Furthermore, quantification of the speed range can be used to reduce the number of memory locations 42 required to store the addressable angular positions. If the number of necessary memory locations 42 is reduced, then the retrieval time for stored angular positions is also reduced.

As previously discussed, the actuating means 30 for throwing the blanket cylinder 2 on and off can be provided by two double-acting pneumatic cylinders. The total of four working chambers of such actuating means can then be driven compressed air by the control unit 4 via the signal lines 7, 8 being in communication with electrically operated solenoid valves 32.

FIG. 5 illustrates a preferred embodiment utilizing two double-acting pneumatic cylinders 21.B, 21.C as the actuating means 30. The blanket cylinder 2 is mounted conventionally at both ends in eccentric bushings 11. The two-stage pivoting of the eccentric bushings 11 can throw the blanket cylinder 2 on to the plate cylinder 1 and impression cylinder 3, or off impression cylinder 3 while remaining in contact with the plate cylinder 1, or off both the printing unit cylinders 1 and 3. The corresponding throw-on/throw-off states shown in FIGS. 1*a*, 1*b* and 1*c* are provided by pivoting the bushings 11 into positions a, b and c shown in FIG. 5.

The structure of the actuating means 30 is discussed in detail in the above-referenced co-pending application 07/691,223. However, a brief discussion of the linking mechanism of the actuating means 30 is included as follows. The bushings 11 are pivoted by way of links 12 and levers 13 located on a throw-off shaft 15 which extends transversely over the width of the printing cylinders 10. Rotating the shaft 14 pivots the two bushings 11 into the throw-on or throw-off positions a, b, c of FIGS. 1 and 5. Rotating the shaft 14 produces a toggle mechanism which is located on the side of the printing cylinders 10 which is embodied by links 15, 16 and which has an abutment 17 rigidly secured to the press frame. The link 15 is pivotally connected to another lever arm 18 of the shaft 14. Furthermore, a link 19 is pivotally connected to the link 15 and pivotally interconnects piston rod 20.B, 20.C of two parallel double-acting pneumatic cylinders 21.B, 21.C which bear non-displaceably on the press frame. When piston rods 20.B, 20.C are in the extended position they move the toggle mechanism 15, 16 into an extended position, causing the blanket cylinder 2 to engage the plate cylinder 1 and impression cylinder 3.

The four working chambers of the cylinders 21.B, 21.C are driven by compressed air under the control of the control unit 4, which regulates the compressed air by controlling solenoid valves 32 via control lines 7, 8. In order to throw the blanket cylinder 2 off the impression cylinder 3, the cylinder 21.B is actuated so that its piston rod 20.B retracts causing a link 19 connected to the toggle mechanism 15, 16 to be moved into a bent or kinked position. In order to completely throw-off the blanket cylinder 2, the cylinder 20.C is energized so that the piston rod 21.C retracts and, by means of leverage provided by link 19, moves the toggle mechanism 15, 16 into a completely bent or kinked position. The bushings 11 have now pivoted into the position C of FIG. 5 and the blanket cylinder 2 has been thrown off the plate cylinder 1.

Throw-on also proceeds in two phases by appropriate actuation of the working chambers of the cylinders 21.B, 21.C, first the piston rod 20.C throwing blanket cylinder 2 thrown on plate cylinder 1, and then the piston rod 20.B extending to throw the blanket cylinder 2 of the impression cylinder 3. Constructing the actuating means 30 in this way with the use of two pneumatic cylinders 21.B, 21.C combines the advantages of a parallel arrangement, and thus additive stroke forces, with the advantages of a serial arrangement additive stroke distances of double-acting working cylinders. Since the cylinders 21.B, 21.C can be actuated individually by the control unit 4 at the times SGD, SGP, the three positions described of the blanket cylinder 2 relatively to the plate cylinder 1 and impression cylinder 3 can be reached. Also, both the cylinders 21.B, 21.C can be operated simultaneously for immediately throwing-off the blanket cylinder 2 from the impression cylinder 3 and plate cylinder 1 simultaneously.

Figure 6A:
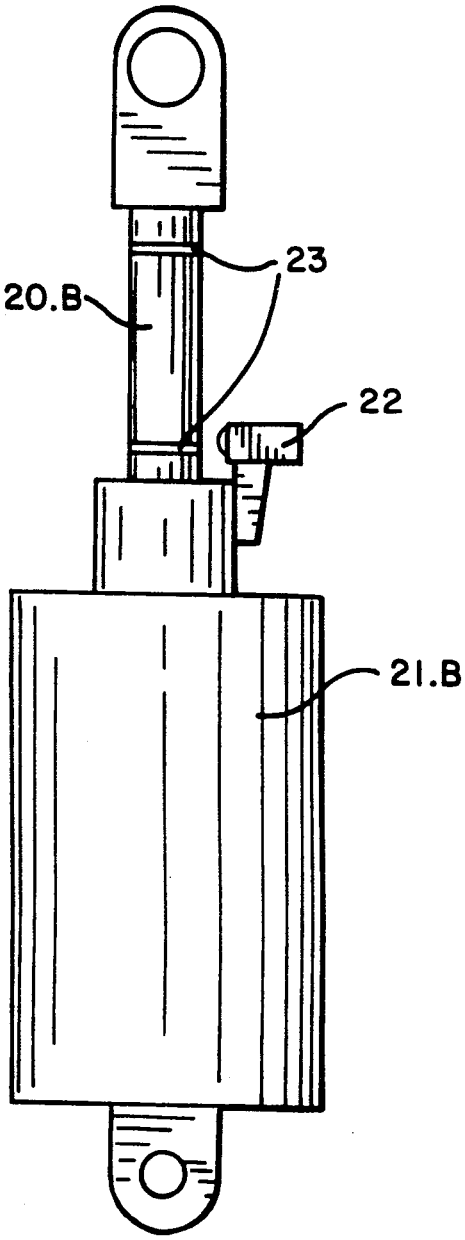
FIGS. 6*a* and 6*b* show sensor arrangements on a pneumatic cylinder of the present invention.
Figure 6B:
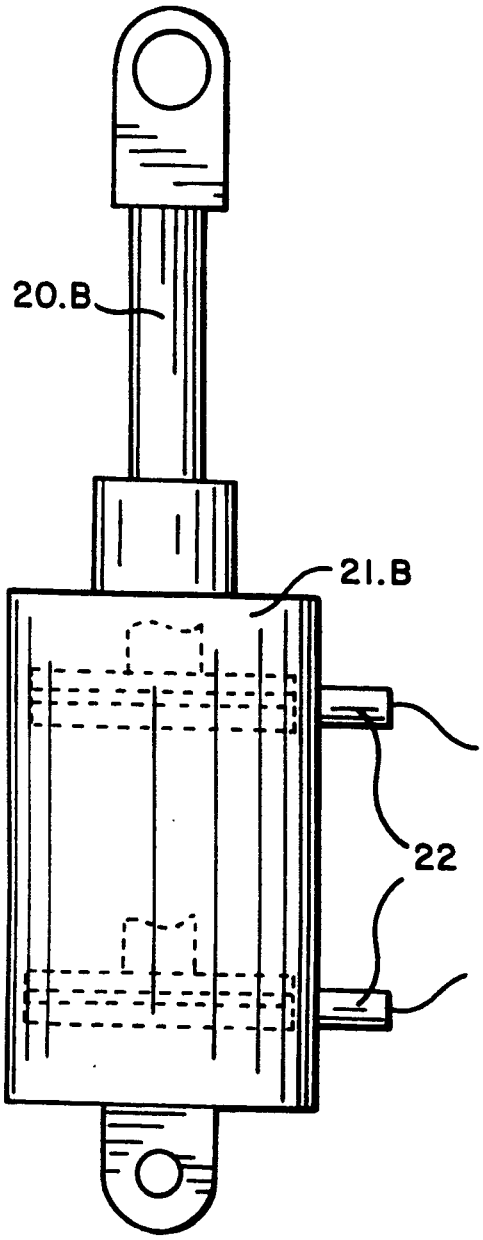

Referring now to FIGS. 6*a* and 6*b*, means for sensing reaction time of the activating means 30 are illustrated in accordance with the present invention. Reaction sensors 22 are positioned on the cylinders 21.B and 21.C. A sensor 22 is positioned near the piston rod 28.B as to be able to detect markings 23 on the piston rod. When the piston 20.B is almost fully extended, i.e., almost in its top end position, the marker 23 is detected by the sensor 22. When the piston rod 20.B is almost fully retracted the top marker 23 is detected by the sensor 22. The sensors 22 outputs a signal exactly when one of the two markers 23 is immediately adjacent to the sensor 22.

When the cylinder 2!.B is so operated that its piston rod 20.B retracts from its extended end position of FIG. 6*a* into its retracted end position, the sensor 22 outputs a pulse at the start of piston rod movement and a pulse at the end thereof. The described arrangement of the sensors 22 in association with the markers 23 enables both the stroke time and the reaction time of the cylinder 21.B to be detected by the timer 4*a*. Since both the cylinders 21.B, 21.C have sensors 22 and markers 23, the signals, for example, pulses, delivered by the two sensors 22 are supplied by way of the signal line 24 to the timer 4*a*.

The sensors 22 can be optical reflex sensors, Hall sensors or reed contacts. Accordingly, the markers or markings 23 can be visually detectable or a small permanent magnet zone in the piston rods 20.B and 20.C. The latter construction of the sensors 22 and markings 23 is preferred since this kind of sensing is substantially independent of possible soiling of the piston rods 20.B, 20.C. Different sensor arrangements or sensors working on some other principle can be used, of course. The only requirement is that a signal or pulse be produced by the sensor 22 at the start and end of the piston movement.

FIG. 6*b* shows another embodiment of the sensor means using two Hall sensors located on the cylinder 21.B near the end positions of its piston, the latter positions being shown in phantom. This embodiment can utilize means for sensing a zone of permanent magnetism.

In summary, the present invention provides a throw on/off control system for a sheet-fed offset press which is self-adjusting based on the speed of the printing press. The control system further compensates for reaction time and stroke time of the actuating means. Overall, the invention provides a cost-effective control system for throw on/off procedures during high speed printing operations by compensating for a conventional throw on/off device.

We claim:

1. A printing unit of a sheet-fed offset press including:

first and second cylinders, each having a printing zone and a gripping zone, and the cylinders being mounted for rotation such that the first cylinder engages the second cylinder at a nip and the printing and gripping zones of the first cylinder are in registration with the printing and gripping zones of the second cylinder;

a control unit for generating triggering signals;

an actuating device responsive to the triggering signals of the control unit for engaging and disengaging the first cylinder to/from the second cylinder for the purpose of beginning/ending a printing cycle when the gripping zones of the first and second cylinders are opposite one another;

a speed sensor for sensing a value of a parameter indicative of the speed of the printing unit and providing the value of the parameter to the control unit; and means in the control unit responsive to the value of the parameter for adjusting the timing of the trigger signals in order to ensure engagement and disengagement of the first and second cylinders occur when the gripping zones of the first and second cylinders are immediately adjacent one another for all speeds of the printing unit.

2. The printing unit as set forth in claim 1, further comprising:

a shaft rotating with the cylinders of the printing unit; and an angular position sensor for detecting angular positions of the printing unit cylinders by being responsive to said shaft, wherein the angular position sensor is in communication with the control unit and transmits the angular position of the cylinders to the control unit.

3. The printing unit as set forth in claim 1, further comprising:

means for driving the printing unit, wherein the speed sensor detects the actual speed of the printing unit from said means, and the speed sensor transmits the actual detected speed to the control unit.

4. The printing unit as set forth in claim 1, further comprising:

pressure means for driving the actuating device; and electrically operated solenoid valves, wherein said solenoid valves are electrically operated by the control unit to regulate said pressure means.

5. The printing unit as set forth in claim 1, further comprising:

a timer in communication with the control unit, wherein reaction sensors are positioned on the actuating device and are in communication with said timer, said timer measuring time elapsing between one of the trigger signals and the start of a movement by the actuating device, defined as reaction time, and the control unit calculating new timing for the trigger signals for future throw-on and throw-off operations based on the received reaction times.

6. The printing unit as set forth in claim 1, further comprising:

a timer in communication with the control unit; wherein reaction sensors responsive to the actuating device and in communication with said timer detect movements between throwing-on and throwing off, said timer measuring the interval between the start and end of the movement, defined as a stroke time, and the control unit calculating new timing for the trigger signals for future throw-on and throw-off operations based on the received stroke times.

7. The printing unit as set forth in claim 1, wherein the actuating device in each printing unit includes double-acting working cylinders operable by compressed air.

8. The printing unit as set forth in claim 7, wherein the double-acting working cylinders each include a piston rod having near and extreme ends, further comprising:

a frame for supporting the printing unit having a rigid abutment;

eccentric bushings wherein the second printing cylinder is mounted in said bushings;

a throw-off shaft having two lever arms connected to said throw off shaft;

a link having two ends, wherein one end of said link is connected to the eccentric bushings, and other end of said link is connected to one of the lever arms of the throw-off shaft; and a toggle mechanism further comprising:

a first link having two ends and a center, wherein one of the ends of said first link is connected to the extreme end of a piston rod of one of the double-acting working cylinders, and the other end of said first link is connected to the extreme end of the piston rod of the other double-acting working cylinder;

a second link having two ends and a center, wherein one end of said second link is connected to the center of the first link, and the other end of said second link is connected to the other lever arm of the throw-off shaft; and a third link having two ends, wherein one of the ends of said third link is connected to the rigid abutment of the frame, and the other end of said third link is connected to the center of the second link.

9. The printing unit as set forth in claim 8, wherein the double-acting working cylinders each include markings on the near and extreme ends of the piston rods, and reaction sensors for sensing when either of the two markings are immediately adjacent to the corresponding reaction sensor.

10. The press as set forth in claim 9, wherein the markings are optically detectable marks and the reaction sensors are optical reflex sensors.

11. The press unit as defined in claim 9, wherein the markings are zones of permanent magnetism and the reaction sensors include a Hall sensor.

12. The press unit as defined in claim 9, wherein the markings are zones of permanent magnetism and the reaction sensors include a reed contact.

* * * * *